US006051937A

United States Patent [19]

Dunphy et al.

[11] Patent Number: 6,051,937

[45] Date of Patent: Apr. 18, 2000

[54] VOLTAGE RATIO REGULATOR CIRCUIT FOR A SPACER ELECTRODE OF A FLAT PANEL DISPLAY SCREEN

[75] Inventors: James C. Dunphy; Donald R. Schropp, Jr., both of San Jose, Calif.

[73] Assignee: Candescent Technologies Corporation, San Jose, Calif.

[21] Appl. No.: 09/087,268

[22] Filed: May 29, 1998

[51] Int. Cl.[7] ..... G05F 1/00

[52] U.S. Cl. ..... 315/291; 315/169.3; 315/169.1; 313/292; 313/497

[58] Field of Search ..... 315/291, 307, 315/308, 169.3, 169.1; 313/494, 496, 497, 422, 495, 292

[56] References Cited

U.S. PATENT DOCUMENTS

| | | | |
|---|---|---|---|
| 5,589,731 | 12/1996 | Fahlen et al. | 313/495 |
| 5,742,117 | 4/1998 | Spindt et al. | 313/422 |
| 5,859,502 | 1/1999 | Spindt et al. | 315/169.3 |

*Primary Examiner*—Haissa Philogene
*Attorney, Agent, or Firm*—Wagner, Murabito & Hao LLP

[57] ABSTRACT

A voltage ratio regulator circuit for a spacer electrode of a flat panel display screen. Within one implementation of a field emission display (FED) device, thin spacer walls are inserted between a high voltage (Vh) faceplate and a backplate to secure these structures as a vacuum is formed between. A phosphor layer on the faceplate receives electrons selectively emitted from discrete electron emitting areas along the backplate (cathode) thereby forming images on the faceplate. The faceplate warms relative to the backplate, as a result of energy released by the phosphor layer, thereby generating a temperature gradient along the spacer walls. The top portion of each spacer wall becomes more conductive with increased temperature and acts to attract electrons that are emitted toward the faceplate. To counter this attraction, a spacer electrode is placed along each spacer wall at a height, d, above the backplate and maintained at a voltage, Ve. Electrodes of all of the spacer walls are coupled together. The spacer electrode at Ve and the high voltage supply at Vh are both coupled to a voltage ratio regulator circuit which maintains the ratio (Ve/Vh) using voltage dividers, an operational amplifier and other circuitry. The voltage ratio regulator compensates for variations in voltage supply performance. The time constants of the voltage ratio regular circuit is tuned to be near or slightly faster than the time constant of the inherent resistance and capacitance of the spacer wall. The invention can also correct for other sources of the voltage error on the spacer walls. The invention improves the electron path accuracy for pixels located near spacer walls.

22 Claims, 11 Drawing Sheets

VOLTAGE RATIO REGULATOR CIRCUIT FOR A SPACER ELECTRODE OF A FLAT PANEL DISPLAY SCREEN

BACKGROUND OF THE INVENTION

1. Field of the Invention

The present invention relates to the field of flat panel display screens. More specifically, the present invention relates to the field of flat panel field emission display (FED) devices.

2. Related Art

An FED device (also called "thin CRT" device) is a thin profile, flat displa device which renders an image on a flat viewing surface in response to electrons striking a phosphor layer. Within the FED device, electrons are typically emitted by field emission. An FED device typically contains a faceplate (also called frontplate or "anode") structure and a backplate (also called baseplate or "cathode") structure connected together through a peripheral or outer wall. The phosphor layer is associated with the faceplate while the electrons are emitted from the backplate. The resulting enclosure is held at a high vacuum. To prevent external forces from the ambient pressure of air from collapsing the thin profile display, one or more spacer structures are located between the faceplate and backplate inside the outer wall.

FIG. 1 illustrates a cross sectional diagram of a prior art FED device 5. The FED device 5 includes a faceplate structure 20, a backplate structure 46, a spacer structure 30 and a high voltage supply 56 coupled to the faceplate structure 20 and the backplate structure 46. Although only one spacer 30 is shown, it is appreciated that the FED device 5 may include similar additional spacers (not shown).

Faceplate structure 20 includes an insulating faceplate layer 10 (typically glass material) and a light emitting structure 12 (typically phosphor) formed on an interior surface of the faceplate 20. Light emitting structure 12 typically includes light emissive materials activated by electron bombardment, such as phosphors which define the active region of the FED display 5. Light emitting structure 12 also includes an anode contact (not shown) which is connected to the positive (e.g., high voltage) side of voltage supply 56.

Backplate structure 46 of FIG. 1 includes an insulating backplate 42 and an electron emitting structure 44 located on an interior surface of backplate 46. Electron emitting structure 44 includes a plurality of selectively energized electron-emitting elements 50*a*–50*d* which are selectively excited to release electrons which accelerate toward the faceplate structure 20. Electron emitting structure 44 is connected, via a cathode contact, to the low voltage side of the voltage supply 56. Because light emitting structure 12 is held at a relatively high positive voltage (e.g., 0.4–10 kV) with respect to electron emitting structure 44, the electrons released by the electron-emitting elements 50*a*–50*d* are accelerated toward corresponding light emissive elements on the light emitting structure 12, thereby causing the light emissive elements (e.g., pixels) to emit light which is perceived by a viewer at the exterior surface of the faceplate 20 (e.g., the flat viewing surface).

Spacer 30 is connected, by a base 30*a* and a top 30*b*, between the substantially planar lower surface of light emitting structure 12 and the substantially planar upper surface of electron emitting structure 44. Spacer 30 has a height of H as shown. If spacer 30 is made of a uniform material having a constant resistivity, the voltage distribution along spacer 30 would be approximately equal to the voltage distribution in free space between electron emitting structure 44 and light emitting structure 12. However, in reality, a temperature gradient develops along spacer 30 between its base 30*a* and its top 30*b* thereby altering the resistance of the spacer 30. Specifically, energy absorbed by the light emitting structure 12 from the impinging electrons or from the environment acts to warm the top 30*b* of spacer 30 more than its base 30*a*. There can be as many as a few degrees Celsius temperature difference between the top 30*b* and bottom 30*a* of spacer 30 during normal FED operation.

The material used for spacer 30 generally has a non-zero thermal coefficient of resistivity (TCR). Therefore, the resistivity of spacer 30 varies depending on its temperature. For example, spacer 30 can become less resistive, and thus more conductive, the warmer it is. This example corresponds to a spacer with a negative TCR; spacers with a positive TCR will have a resistance that increases with temperature. As a result, in this example, during display operation, the top 30*b* of spacer 30 becomes slightly more conductive than its bottom 30*a* and a resistance gradient (see FIG. 2A) builds up along the height of the spacer 30. Therefore, a larger positive voltage builds up along spacer 30 than would be there under ideal conditions. This larger positive voltage along spacer 30 tends to pull electrons off course that pass nearby and deflects them toward the spacer 30 as shown by an exemplary and exaggerated electron path 34. Because each electron emitting structure 50*a* is paired with a particular phosphor spot within light emission layer 12, pulling the electron off its intended (straight) path causes a degradation of image quality as the electron misses its designated target. The net effect of the deflection on many electrons is to move the center of brightness of the pixels near the spacer. This appears to the user as dark or light pixel rows at the spacer location.

FIG. 2A, FIG. 2B and FIG. 2C illustrate the temperature and resistance gradients built up along the spacer 30 and their effects on the spacer's voltage. FIG. 2A illustrates a graph 60 having a line 62 which illustrates the resistance gradient along the height of spacer 30 from base 30*a* (the cathode) to the top 30*b* (at height H, at the faceplate 20 ). As shown by the resistance gradient 62, the spacer 30 becomes less resistive closer to its top 30*b*. Graph 60 also shows the temperature gradient 64 along the height of the spacer 30 from its base 30*a* (e.g., position 0 ) to its top 30*b* (e.g., at height H) near the faceplate 20.

FIG. 2B illustrates a graph 70 of the voltage levels along the height of spacer 30 from position 0 (at base 30*a*) to position H (at top 30*b*). Line 74 represents the ideal voltage along the height of spacer 30 assuming a uniform spacer with no temperature gradient. Line 72 is an exaggerated depiction and represents the actual voltage level along the spacer 30 taking into consideration its temperature gradient 64 (FIG. 2A). As shown, the mid point 76 on line 72 has the largest voltage deviation from the ideal voltage line 74. Mid point 76 represents a point along the height of spacer 30 at a height of H/2.

FIG. 2C is a graph 80 illustrating a representation 82 of the voltage error between the actual voltage line 72 and the ideal voltage line 74 (FIG. 2B) along the height of the spacer 30. Graph 80 is very nearly parabolic in shape. The maximum error point 88 is located at the mid point (H/2) because the top 30*b* and the base 30*a* of spacer 30 are held at known voltage levels as a result of the voltage supply 56 contacting the spacer 30 at these points. Therefore, the temperature gradient along spacer 30 operates to produce the most positive voltage error at the mid point (H/2) of spacer 30.

Accordingly, it would be desirable to reduce the positive voltage errors (FIG. 2C) that are seen along the height of the spacer 30 so that unwanted electron deflections toward the spacer 30 can be minimized and/or eliminated. By so doing, overall image quality of the FED device can be increased. It would be desirable to provide an FED device that partially compensated for the positive voltage errors along the height of the spacer 30 that are attributed to the temperature gradient of the spacer 30 and to other causes described below. The present invention provides such an advantage. These and other advantages of the present invention not specifically mentioned above will become clear within discussions of the present invention presented herein.

SUMMARY OF THE INVENTION

A voltage ratio regulator circuit is described herein for a spacer electrode of a flat panel display screen. Within one implementation of a field emission display (FED) device, thin spacer walls are inserted between a high voltage (Vh) faceplate structure and a backplate structure to secure these structures as a vacuum is formed between. A phosphor layer on the faceplate structure receives electrons selectively emitted from discrete electron emitting areas along the backplate (cathode) structure thereby forming images on the faceplate structure. However, the faceplate structure warms relative to the backplate structure, as a result of energy released by electrons impinging on the phosphor layer, thereby generating a temperature gradient along the height of the spacer walls. Warming can also occur due to environment conditions, e.g., sun shining on the faceplate. For a spacer with negative TCR, the top portion of each spacer wall becomes more conductive with increased temperature and therefore acts to attract electrons that are emitted toward the faceplate structure. For a spacer with positive TCR the opposite occurs and electrons are repelled.

To counter the electron attraction induced by the temperature gradient along the spacer wall, a spacer electrode is placed along each spacer wall at a height, d, above the backplate structure and maintained at a voltage, Ve. In one embodiment, d is about ¼ the distance between the faceplate structure and the backplate structure. Electrodes of all of the spacer walls are coupled together. The spacer electrode at Ve and the high voltage supply at Vh are both coupled to a voltage ratio regulator circuit which maintains the voltage ratio (Ve/Vh) using voltage dividers, an operational amplifier controlled current sink and other circuitry. In one embodiment, the ratio (Ve/Vh) is approximately ¼. The voltage ratio regulator circuit and system of the present invention compensate for variations in voltage supply performance. The time constants of the voltage ratio regulator circuit is tuned to be slightly faster than the time constant of the inherent resistance and capacitance of the spacer wall. The invention improves the electron path accuracy for pixels located near spacer walls.

Specifically, embodiments of the present invention include a voltage regulator system for a field emission display device including: a high voltage power supply coupled between a faceplate and a baseplate, the faceplate and the baseplate separated by a distance, H; a spacer coupled between the faceplate and the baseplate, the spacer having disposed thereon a spacer electrode for compensating for electron deflections induced by temperature gradients along the spacer and also to compensate for electron deflections caused by other sources; and a voltage regulator circuit coupled to receive a high voltage from the high voltage power supply, coupled to the spacer electrode and coupled to a reference voltage, the voltage regulator circuit for maintaining a voltage ratio between a voltage at the spacer electrode and the high voltage in response to voltage variations of the high voltage power supply. Embodiments include the above and wherein the voltage ratio is approximately one quarter and wherein the spacer electrode is located on the spacer at a height of approximately H/4 above the baseplate.

Embodiments of the present invention include the above and wherein the voltage regulator circuit includes: a first voltage divider circuit coupled to receive the high voltage from the high voltage power supply, the first voltage divider circuit for providing a first divided voltage to a first input of an operational amplifier circuit; a second voltage divider circuit coupled to receive the voltage from the spacer electrode, the second voltage divider circuit for providing a second divided voltage to a second input of the operational amplifier circuit; and the operational amplifier circuit for maintaining the voltage ratio between the voltage of the spacer electrode and the high voltage by generating a first output state for increasing the voltage at the second input of the operational amplifier in response to an increase in the high voltage of the high voltage power supply and by generating a second output state for decreasing the voltage at the second input of the operational amplifier in response to a decrease in the high voltage of the high voltage power supply.

In addition to correcting for thermal gradient included voltage error, the present invention can correct for other sources of spacer voltage errors. The presence of the wall may itself cause a deflection of the electron beam due to the detailed structure of the cathode and faceplate not precisely matching the wall ends. The present invention can correct for this. Additionally, the wall charges due to Rutherford scattered electrons from the faceplate hitting it. This charging causes voltage errors which also will deflect the electrons. The present invention can reduce this error by quickly discharging the walls during the time period when no pixels near any of them are lit up.

DETAILED DESCRIPTION OF THE INVENTION

In the following detailed description of the present invention, a voltage ratio regulator circuit for regulating the voltage of a spacer electrode which is used to compensate for temperature induced electron deflections within an FED device and also to compensate for electron deflections caused by other sources, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail so as not to unnecessarily obscure aspects of the present invention.

Figure 1:
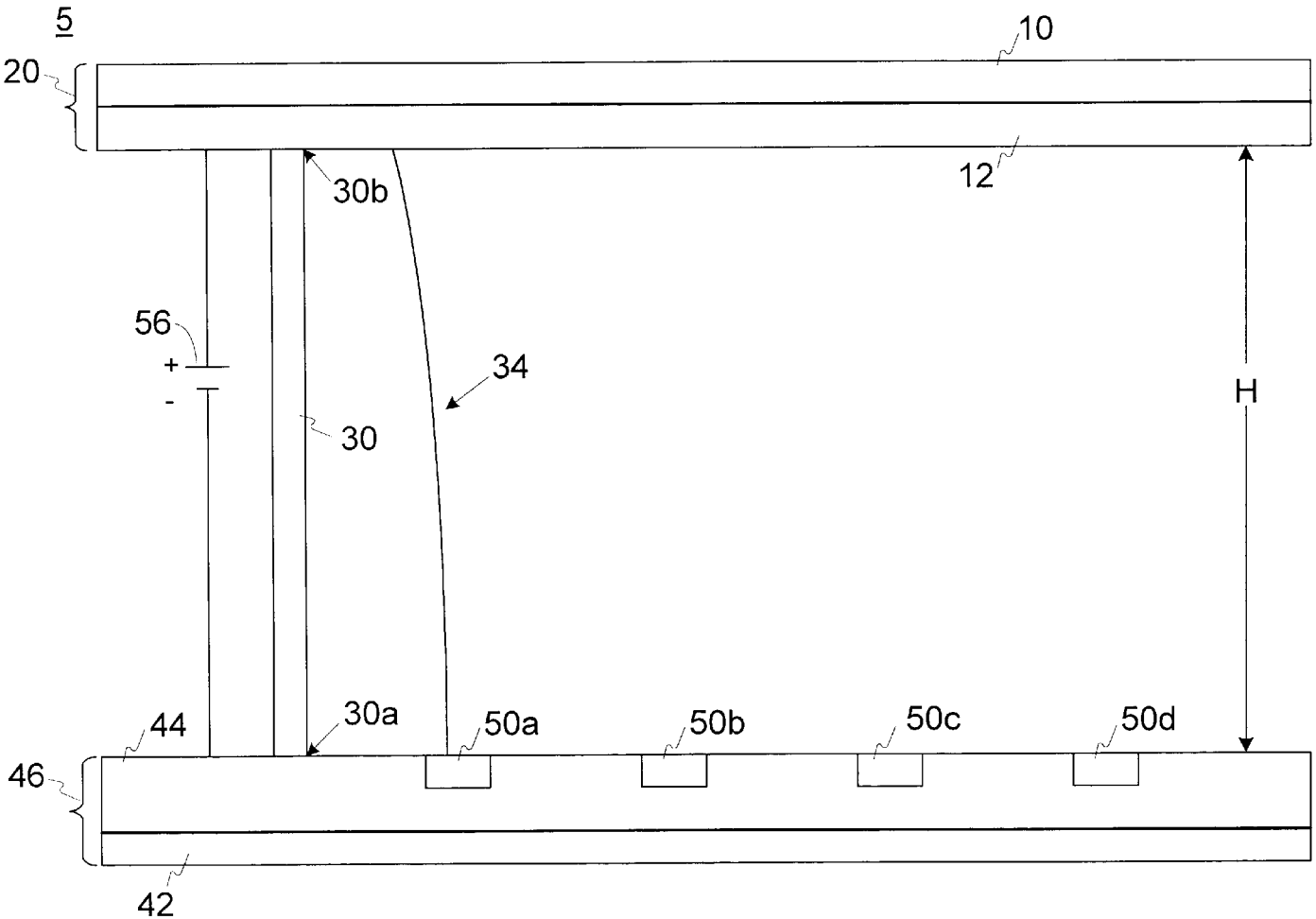
FIGURE 1 (Prior Art)
FIG. 1 illustrates a cross section of a prior art FED device showing a spacer wall, a faceplate structure and a backplate structure.
Figure 2A:
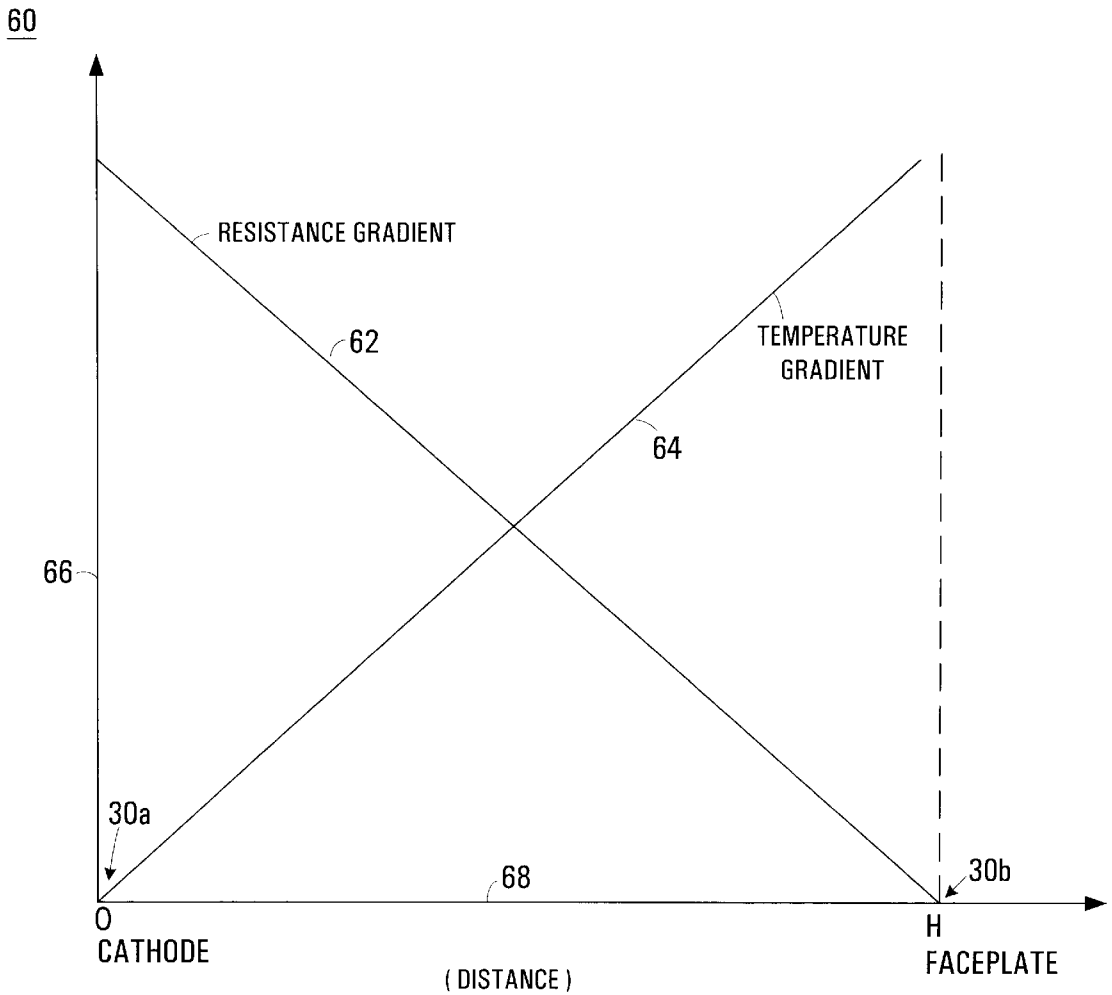
FIGURE 2A (Prior Art)
FIG. 2 is a graph illustrating the resistance and the temperature gradients along the height (e.g., distance) of the spacer wall of FIG. 1 measured above the backplate structure.
FIG. 2B is a graph illustrating the actual voltages and the ideal voltages along the height (e.g., distance) of the spacer wall of FIG. 1 measured above the backplate structure.
FIG. 2C is a graph illustrating the voltage error along the height (e.g., distance) of the spacer wall of FIG. 1 between the voltage and the ideal voltage of FIG. 2B.
Figure 2B:
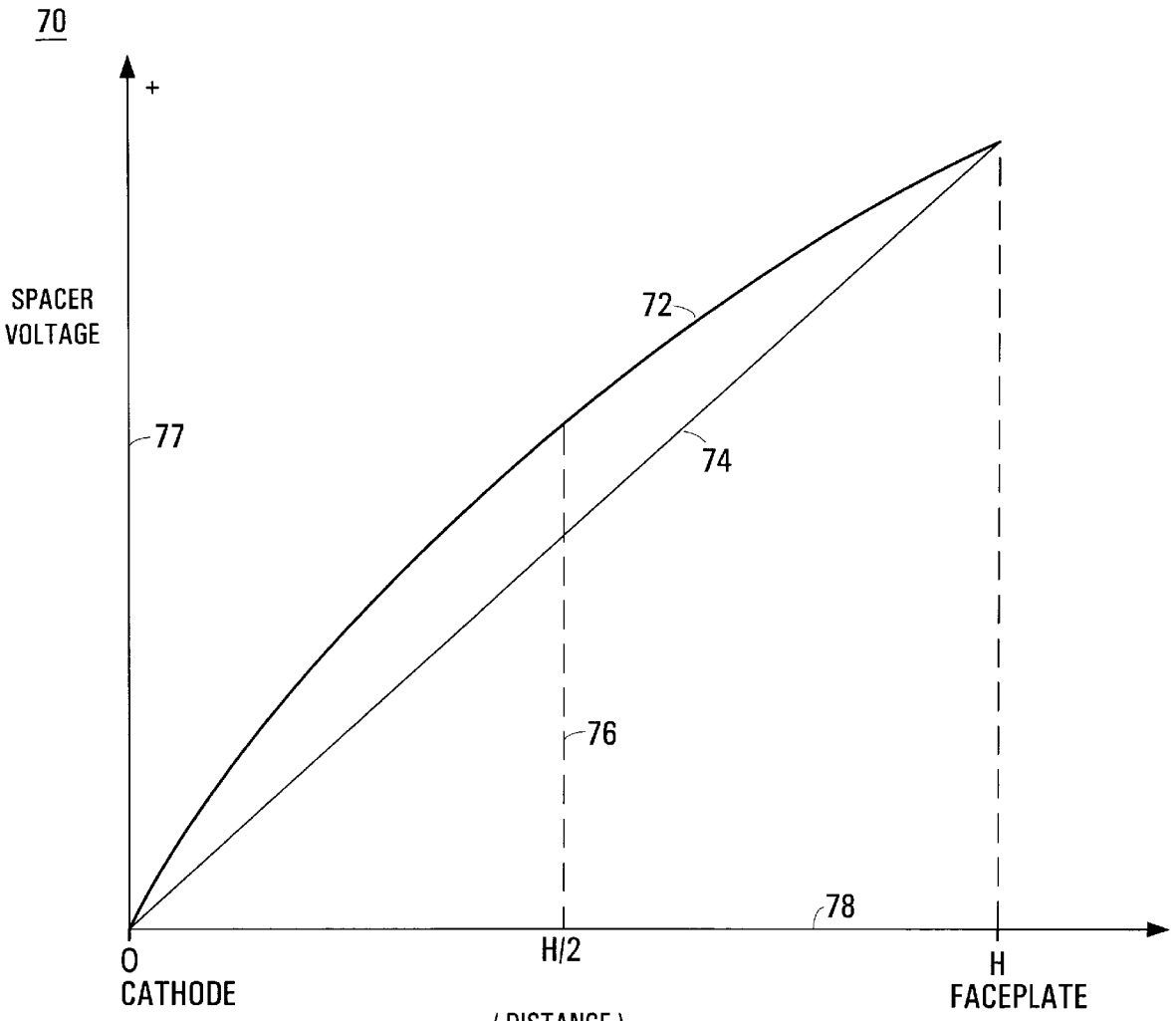
FIGURE 2B (Prior Art)
Figure 2C:
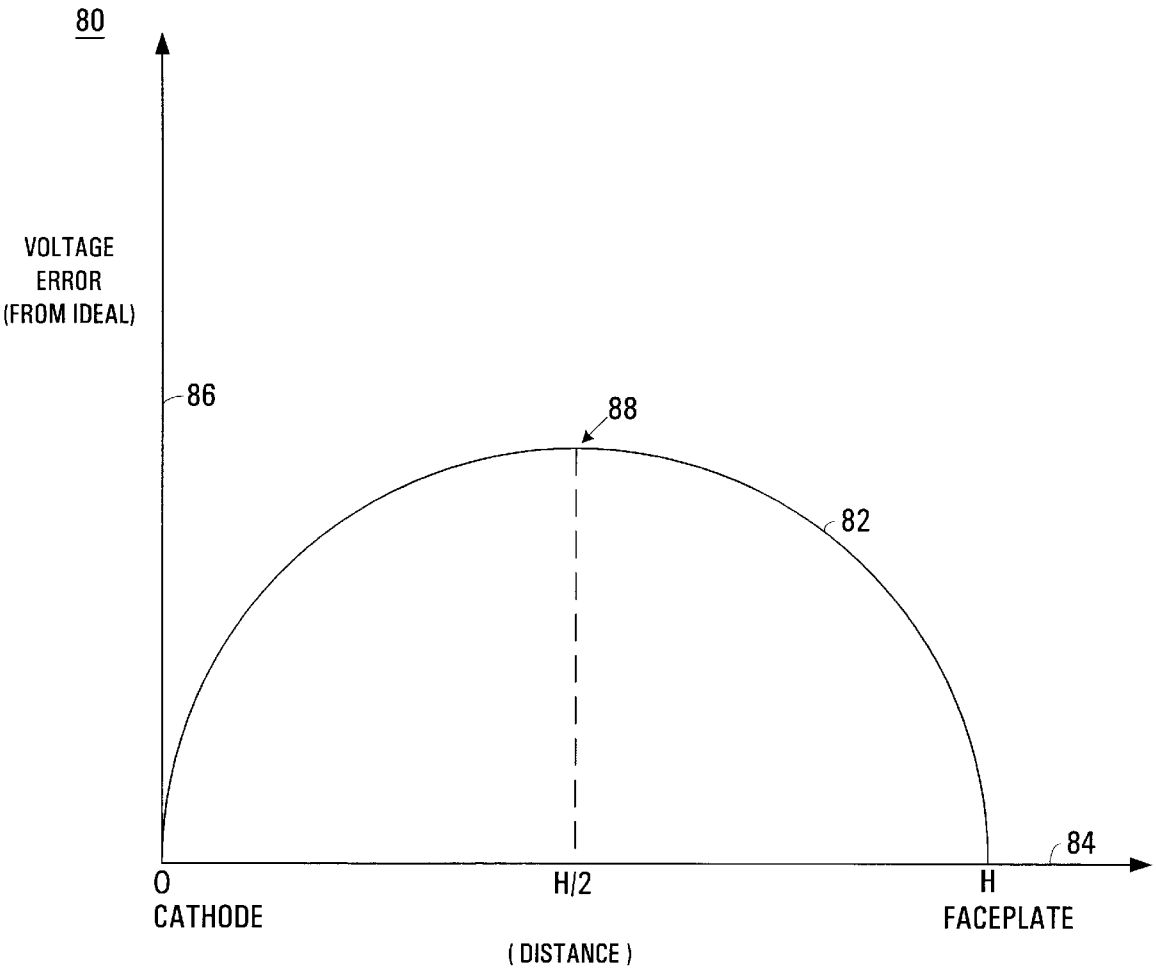
FIGURE 2C (Prior Art)
Figure 3:
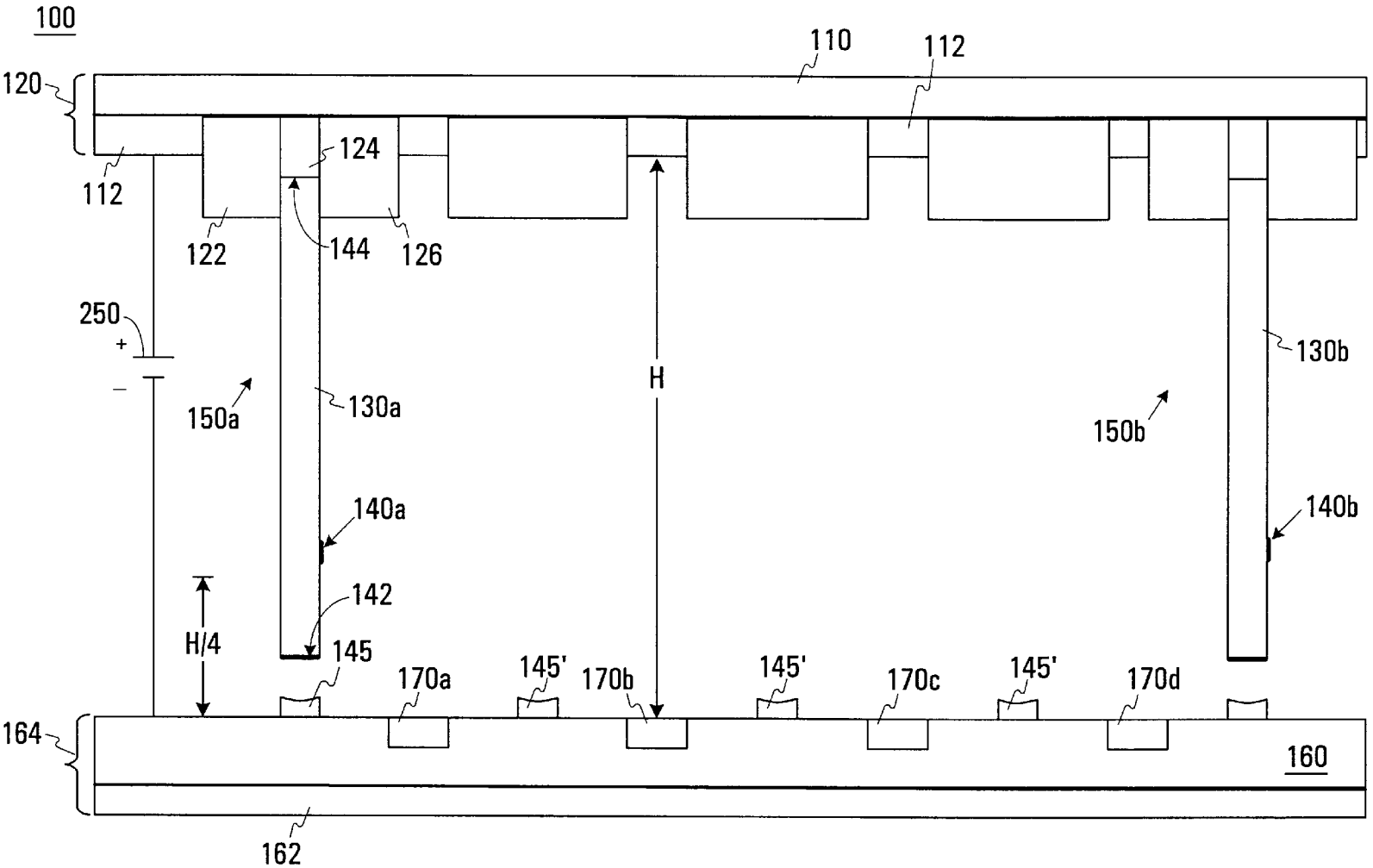
FIG. 3 is a cross sectional diagram of an FED device in accordance with one embodiment of the present invention illustrating spacer walls having electrodes disposed thereon.

FIG. 3 illustrates a cross sectional diagram of an implementation of a FED device in accordance with one embodiment of the present invention. The FED device 100 includes a faceplate structure 120 ("faceplate"), a backplate structure 164 ("backplate"), spacer structures 150*a*–150*b* and a high voltage supply 250 coupled to the faceplate structure 120 and the backplate structure 164. Although two spacer structures ("spacers") 150*a*–150*b* are shown, embodiments of the present invention may include additional spacers (not shown). The faceplate structure 120 and the baseplate structure 164 are separated by a distance, H. Faceplate 120 is described in U.S. Pat. No. 5,477,105 which is assigned to the assignee of the present invention.

Faceplate structure 120 includes an insulating faceplate layer 110 (typically glass material) and a light emitting structure 112 (typically phosphor) formed on an interior surface of the faceplate 120. Light emitting structure 112 typically includes light emissive materials, such as phosphors which define the active region of the FED display 100. Light emitting structure 112 also includes an anode contact (not shown) which is connected to the positive (e.g., high voltage) side of voltage supply 250.

Backplate structure 164 of FIG. 3 includes an insulating backplate 162 and an electron emitting structure 160 located on an interior surface of backplate 164. Backplate 164 is described in commonly owned U.S. patent application Ser. No. 08/081,913 now U.S. Pat. No. 5,686,790. Electron emitting structure 160 includes a plurality of selectively energized electron-emitting elements 170*a*–170*d* which are selectively excited to release electrons which accelerate toward the faceplate structure 120. Electron emitting structure 160 is connected, via a cathode contact, to the low voltage side of the voltage supply 250. Because light emitting structure 112 is held at a relatively high positive voltage (e.g., 0.4–10.0 kV) with respect to electron emitting structure 160, the electrons released by the electron-emitting elements 170*a*–170*d* are accelerated toward corresponding light emissive elements on the light emitting structure 112. This causes the light emissive elements (e.g., pixels) to emit light which is perceived by a viewer at the exterior surface of the faceplate 210 (e.g., the flat viewing surface).

Spacer 150*a* includes a spacer wall 130*a* that is disposed between a metalized polyimide electron focus structure 145 and a layer 124 typically of graphite, a polyimide, or metal material. The spacer wall is described in commonly owned U.S. patent application Ser. No. 08/414,408 now U.S. Pat. No. 5,614,781 and 08/505,841. On either side of layer 124 are support grippers or locators 122 and 126 which are both secured to the insulating faceplate layer 110. A metal (e.g., conductive) layer overlies the support grippers or locators and the light emitting structures. A metal contact 144 is disposed on the top of the spacer wall 130*a* and makes contact with the overlying metal layer. Layer 124 also makes electrical contact with faceplate structure 120. Another metal contact 142 is disposed at the bottom of the spacer wall 130*a* and makes contact with the focus metal 145 which is coupled to the cathode. In this configuration, the top end of the spacer wall 130*a* is held at the high voltage level (e.g., 400 to 10,00 volts) because the positive end of high voltage supply 250 is coupled to the faceplate 120. Also, the bottom end of spacer wall 130*a* is held at the reference voltage level (e.g., close to ground, but can vary between +/−50V as required by electron beam focusing elements) because the ground of the high voltage supply 250 is coupled to the backplate 164. The backplate 164 is referred to as the "cathode" in this configuration. The grippers or locators 122 and 126 secure or locate the top of the spacer wall 130*a* and are made of a polyimide material in one implementation. The spacer wall 130*a* is fabricated using a ceramic material, in one embodiment, and is electrically resistive at 1010–1013 ohms/sq., but not electrically insulating.

The material used for spacer wall 130*a* of FIG. 3 has a non-zero thermal coefficient of resistivity (TCR). Therefore, the resistivity of spacer wall 130*a* varies depending on its temperature and, specifically, for the case of negative TCR, spacer wall 130*a* becomes less resistive, and thus more conductive, the warmer it is. During display operation, the top end of spacer wall 130*a* becomes warmer than its bottom end (near the focus element 145) due to the absorption of electron energy by the light emissive structure 112 or due to environmental effects. As a result, the top end of spacer wall 130*a* becomes slightly more conductive than its bottom end and therefore a larger positive voltage builds up along spacer wall 130*a* than would be there without any temperature gradients. This larger positive voltage along spacer wall 130*a* tends to pull electrons off course that pass nearby and incorrectly deflects them toward the spacer wall 130*a*.

Therefore, the present invention includes a spacer electrode 140*a* on the spacer wall 130*a*. The spacer electrode 140*a* is disposed along the length of the spacer wall and is shown in FIG. 3 in cross section only. The spacer electrode 140*a* is located approximately a distance H/4 above the backplate structure 164. In one implementation, the spacer electrode 140*a* is approximately 40 microns wide and is preferably fabricated as thin as reasonable manufacturing processes allow on top of the spacer wall 130*a*. The spacer electrode 140*a* is coupled to a voltage supply in order to force the electrode 140*a* to the voltage that would be at its location, along the spacer wall 130*a*, if temperature gradients were not present. That is, if temperature gradients along the spacer wall 130*a* did not exist, the voltage distribution along the height of the spacer wall 130*a* is linear. Therefore, the voltage at the height of the spacer electrode 140*a* would be approximately ¼ of the high voltage amount (originating from supply 250) when the spacer electrode 140*a* is located approximately H/4 above the backplate 164.

Generalizing, if the spacer electrode 140*a* was located at a distance H/N above the backplate structure 164, then the voltage of the spacer electrode 140*a* of the present invention would be 1/N of the high voltage amount for N equal to or greater than 1. By forcing the spacer electrode 140*a* to the voltage level that would exist without temperature gradients being present along the spacer wall 130*a*, the present invention partially compensates for the voltage error caused by the presence of temperature induced resistance gradients along the spacer wall 130*a*. Additionally, any other voltage pertubation mechanism can have its effects mitigated by this electrode placement and associated circuit. The amount by which the spacer electrode 140*a* of the present invention compensates for the voltage error caused by the presence of temperature and resistance gradients is discussed in further detail below.

Alternative spacer embodiments that can be used in accordance with the present invention are also described within co-pending U.S. patent application Ser. No. 08/684,270 now U.S. Pat. No. 5,859,502, entitled "Spacer Locator Design for 3-D Focusing Structures in a Flat Panel Display," filed on Jul. 17, 1996 and assigned to the assignee of the present invention. Yet other alternative spacer embodiments are also described in co-pending U.S. patent application Ser. No. 09/053,247, entitled "Structure and Fabrication of Flat-Panel Display Having Spacer With Laterally Segmented Face Electrode," filed on Mar. 31, 1998 and assigned to the assignee of the present invention. Both of the above referenced patent applications are incorporated herein by reference.

Figure 4:
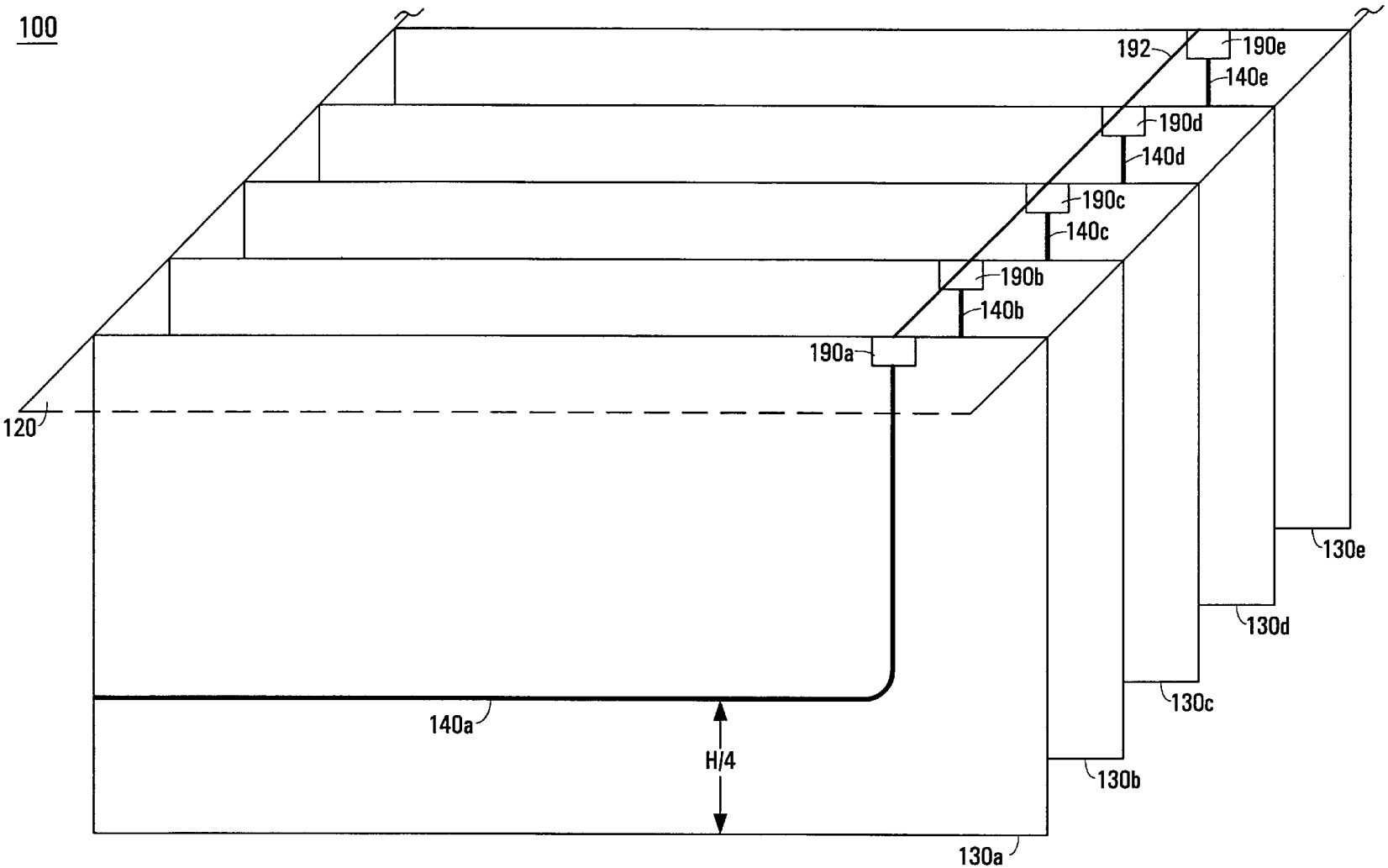
FIG. 4 is a perspective cut away diagram illustrating multiple spacer walls (with electrodes) in accordance with an embodiment of the present invention.

FIG. 4 illustrates a perspective cut away diagram of the FED device 100 in accordance with the present invention. In this embodiment, there are five parallel aligned spacer walls 130*a*–130*e* shown in perspective view. The elements of FIG. 4 are not drawn to scale. The five spacer walls 130*a*–130*e* are exemplary in number only. Embodiments of the present invention are equally well suited for application with an FED device that has more than five spacer walls or less than five spacer walls. A cut away of the faceplate plane 120 is shown for perspective. The backplate structure 164 (not shown in FIG. 4 for clarity) is located under the spacer walls 130*a*–130*e*.

Side views of spacer wall 130*a* and its corresponding spacer electrode 140*a* are shown without obstruction. Spacer electrodes 140*b*–140*e* for spacer walls 130*b*–130*e* are shown in obstructed views only but are analogous in shape and structure to the spacer electrode 140*a*. The spacer electrode 140*a* is disposed along the length of the spacer wall 130*a* at a height of H/4 and is routed upwards to a common node wire bond or contact 190*a*. The same is true for the spacer electrodes 140*b*–140*e* of each of the other spacer walls 130*a*–130*e*, and these spacer electrodes 140*b*–140*e* respectively coupled to wire bonds 190*b*–190*e*. The wire bonds 190*a*–190*e* are all coupled together via a common wire or electrode line 192 which runs within the plane of the faceplate 120 forming a common electrical node for all spacer electrodes 140*a*–140*e*. In accordance with the present invention, the voltage at which the spacer electrodes 140*a*–140*e* are to be maintained is coupled to line ("node") 192 for distribution to all of the spacer walls 130*a*–130*e*.

Figure 5:
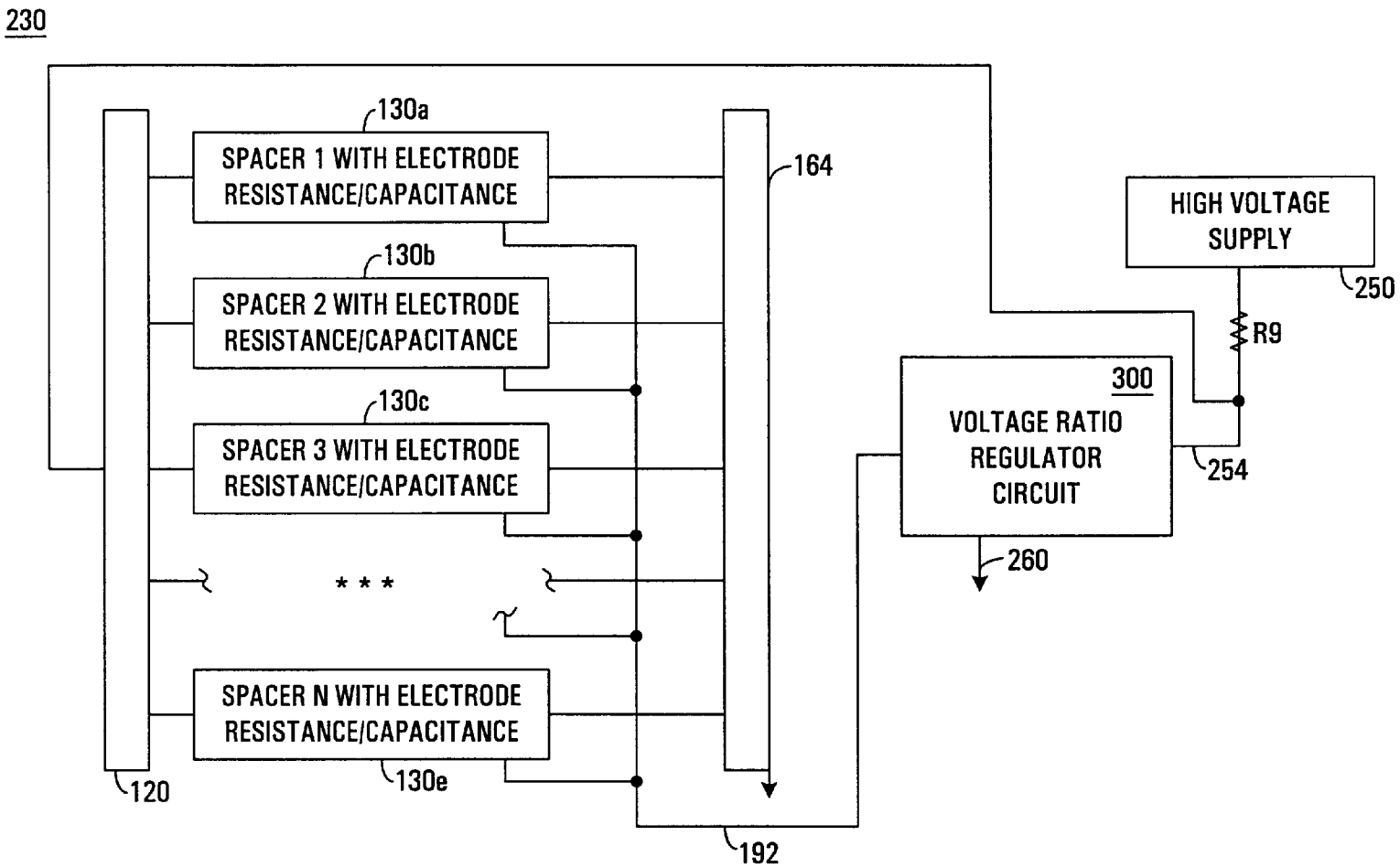
FIG. 5 is a logical block diagram of a voltage ratio regulator system in accordance with the present invention for regulating the voltage ratio along the spacer electrodes with respect to the high voltage of the faceplate structure.

FIG. 5 illustrates an electrical diagram of the voltage ratio regulation system 230 in accordance with the present invention that utilizes the spacer electrodes 140*a*–140*e*. The high voltage supply 250, as discussed with respect to FIG. 3, is coupled to the faceplate structure 120 and the backplate structure 164 is coupled to ground (+/−50v). The high voltage supply 250 of FIG. 5 is also coupled through an optional resistor R9 to node 254. Node 254 is coupled to a voltage ratio regulator circuit 300 of the present invention which is also coupled to node 192 and circuit 300 is also coupled to ground 260. The high voltage source 250 is also coupled to the faceplate structure 120 to provide it with high voltage. As discussed with respect to FIG. 4, and as shown in FIG. 5, node 192 is coupled to each of the spacer electrodes 140*a*–140*e* of the spacer walls 130*a*–130*e*. The elements 130*a*–130*e* shown in FIG. 5 are the electrical equivalents (e.g., resistance and capacitance) of i number of spacer walls including spacer electrodes. The other ends of the spacer walls are electrically coupled to the backplate structure 164. Therefore, each spacer wall is coupled to (1) the high voltage source 250, (2) the voltage regulator circuit (by node 192) and (3) ground(+/−50v).

Due to variations within the commercial manufacturing processes and variations within the components used for high voltage power supply units, the high voltage level generated by high voltage supply 250 can vary as much as 10% from unit to unit and can also vary over time within a same unit 250. Mainly, it varies with load, e.g., display brightness. Variations within the high voltage level generated by the high voltage power supply 250, if left not corrected, can alter the ideal voltage of the spacer electrodes 140*a*–140*e* thereby causing electron deflections. For this reason, an embodiment of the present invention includes a voltage ratio regulator circuit 300.

In accordance with the present invention, the purpose of the voltage ratio regulator circuit 300 of FIG. 5 is to maintain the voltages at node 192 such that the voltage at node 192 divided by the voltage at node 254 is a fixed ratio. Therefore, circuit 300 holds the spacer electrode voltage at a precisely fixed fraction of the high voltage independent of the power supply voltage and the equilibrium voltage of the spacer electrode, over the range that these voltages may normally vary. The particular ratio depends on the height of the spacer electrodes 140*a*–140*e* above the backplate structure 164. For instance, if the heights of the spacer electrodes 140*a*–140*e* are approximately located H/N above the backplate structure 164, then the ratio of voltages maintained by the voltage ratio regulator circuit 300 would be very nearly 1/N (where N is equal to or greater than one). In a preferred embodiment, the spacer electrodes 140*a*–140*e* are located H/4 above the backplate structure 164 and therefore circuit 300 maintains the ratio of the voltage on node 192 divided by the voltage on node 254 to be ¼. For example, if the high voltage on node 254 is 5,000 volts, then the voltage circuit 300 applies to the spacer electrodes 140*a*–140*e* would be 1,250 volts.

Figure 6A:
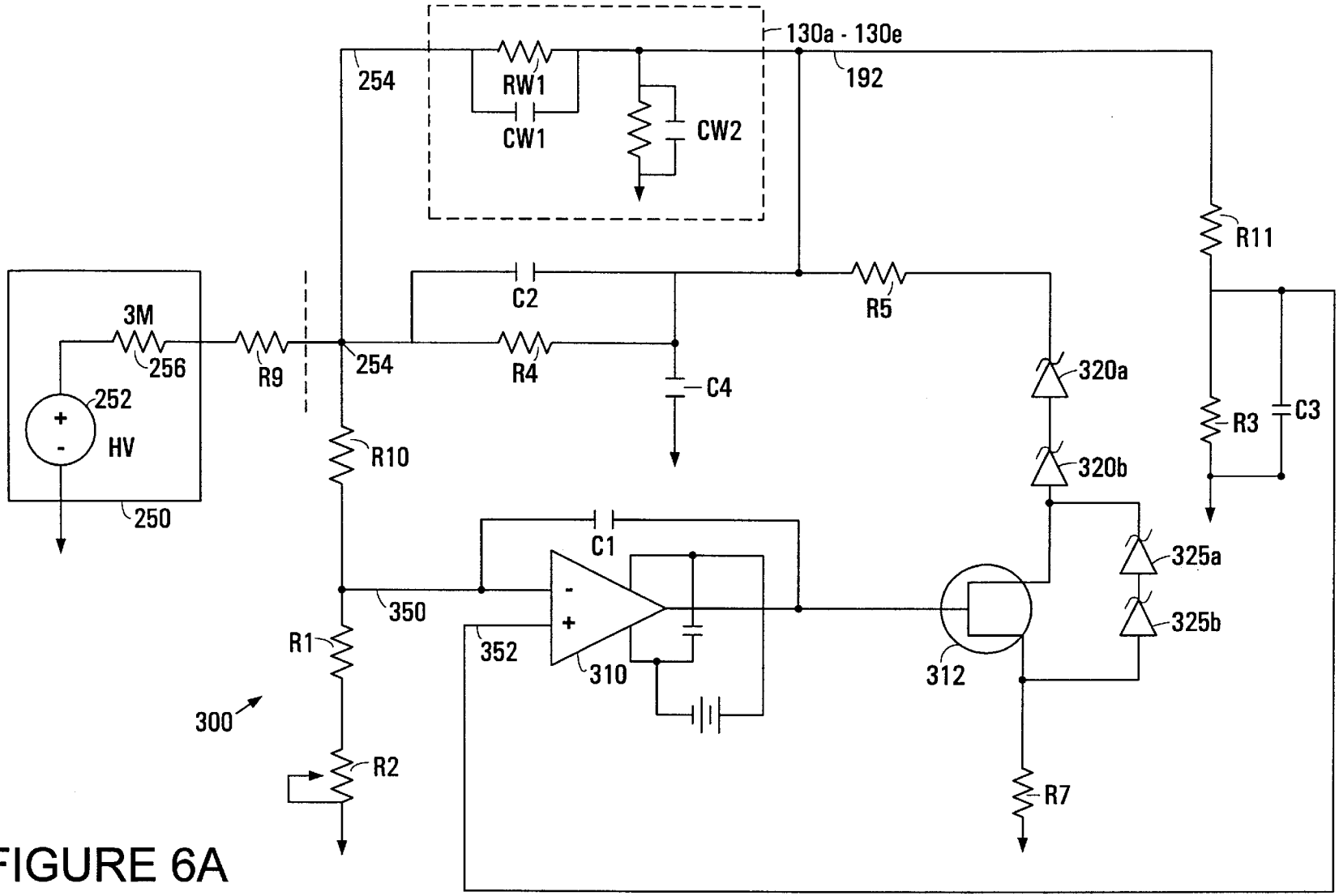
FIG. 6A is a schematic circuit diagram of the voltage ratio regulator circuit of the voltage ratio regulator system in accordance with a first embodiment of the present invention.

FIG. 6A is a circuit diagram of the elements of the voltage ratio regulator circuit 300 in accordance with a first embodiment of the present invention. Circuit 300 includes two voltage dividers and an active feedback circuit that contains an operational amplifier-controlled current sink (e.g., a transistor) and is used to hold equal the voltages of the voltage dividers.

Dashed box 130*a*–130*e* of FIG. 6A represents the electrical characteristics RW1 and RW2 (and CW1 and CW2) representing the resistance and capacitance for the i number of spacer walls 130*a*14 130*e*. In one embodiment, the sum of RW1+RW2 is between 500 and 600 M ohms. As shown, the spacer walls 130*a*–130*e* are coupled to the high voltage level at node 254 (the "high voltage node"), also coupled to ground, and their spacer electrodes 140*a*–140*e* are coupled to the spacer electrode node 192 ("the spacer electrode node"). The material of the spacer walls 130*a*–130*e* has a resistance of $10^{10}$–$10^{13}$ ohms/sq. Also coupled to circuit 300 is the high voltage power supply 250. Supply 250 contains a voltage source 252, an effective resistance 256 (approximately 3M ohm) coupled in series with an optional limiter resistor R9 (approximately 1M ohm) which is coupled to node 254. Resistor R9 is optional and is used to prevent arcing.

The voltage ratio regulator circuit 300 contains a first voltage divider circuit composed of resistor R10 coupled with resistors R1 and resistor R2. Resistor R2 is optionally adjustable for tuning. R2 adjusts the voltage ratio. It can be used to center the brightness centroid of the pixels near the wall to compensate for many types of manufacturing variations, e.g., electrode height. Resistors R1 and R2 can be combined into one resistor. Resistor R10 is coupled to node 254, coupled in series to resistor R1 which is coupled in series to R2 which is coupled to ground. The node of resistor R1 that is not coupled to resistor R2 is coupled, at node 350, to a first input of an operational amplifier circuit 310. In one embodiment, resistor R1 is coupled to the negative input of operational amplifier circuit 310. The voltage ratio regulator circuit 300 also contains a second voltage divider circuit composed of resistor R11 coupled in series with resistor R3. Resistor R11 is coupled to node 192 and coupled in series to resistor R3 which is coupled to ground. A capacitor C3 is coupled in parallel across resistor R3. The node of resistor R3 that is not coupled to ground is coupled, at node 352, to a second input of an operational amplifier circuit 310. In one embodiment, resistor R3 is coupled to the positive input of operational amplifier circuit 310.

Node 254 of FIG. 6A is also coupled to resistor R4 which is coupled in series to capacitor C4 which is coupled to ground. Capacitor C4 is coupled to node 192. Optional capacitor C2 is coupled in parallel across resistor R4 and coupled to capacitor C4 at node 192. Node 192 is coupled to resistor R5 which is coupled in series to optional Zener diodes 320*a* and 320*b* which are coupled to each other in series. An active feedback circuit includes elements R4, C4, C2 and R5. Optional diode 320*b* is coupled to transistor 312 which is coupled to resistor R7 in series and resistor R7 is coupled to ground. Optional series-coupled coupled Zener diodes 325*a*–325*b* are coupled in parallel across the source and drain of transistor 312 and can be built into some transistor packages. Zener diodes 325*a* and 325*b* are used to protect transistor 312 from excessive drain-source voltage. The gate of transistor 312 is controlled by the output of the operational amplifier 310. Capacitor C1 is coupled between the negative input 350 of operational amplifier 310 and the output of operational amplifier 310.

In one implementation, transistor 312 of FIG. 6A is a field effect transistor (FET) but alternatively could be a bi-polar NPN transistor. Although a number of different operational amplifier circuits can be used, in one implementation of the present invention, amplifier circuit 310 contains FET inputs (e.g., AD549, AD820). Also, in one implementation, 200v Zener diodes are used for diodes 320*a*–320*b* and diodes 325*a*–325*b*. The operating range of the transistor 312 is approximately from zero to 450v and selection of R4 and R5 and the number of Zener diodes 320*a*–320*b* are preferably done to place transistor 312 in the middle of its operating range.

The values of the resistors located within the voltage divider circuits are set depending the ratio of voltages desired between the spacer electrode node 192 and the high voltage node 254. Assuming the desired ratio is 1/N, then the following expression is used to determine these values (provided R10 and R11 are equal):

$$(1/N)=[(R1+R2)/R3]$$

where (1/N) also represents the fraction of the height H along the spacer wall 130*a* that spacer electrode 140*a* is placed, as measured above the backplate structure 164. Also R2=0.1 R1 to provide a 10 percent adjustment.

In a more general case, the following expression can be used:

$$\frac{Vhv(R1+R2)}{R10+R1+R2}=\frac{Ve(R3)}{R11+R3}$$

where Vhv is the high voltage and Ve is the spacer electrode voltage. The ratio to be maintained is therefore:

$$\frac{Ve}{Vhv}=\frac{R11+R3}{R10+R1+R2}\times\frac{R1+R2}{R3}$$

The value of R3 within circuit 300 is selected to properly set the inputs to the operational amplifier 310 near the center of its operating range ("common mode" range). Further, R7 is selected to set the proper output voltage on the operational amplifier 310 and also where the gate to source voltage of the transistor 312 is approximately 1.0 volt, in one implementation. The values of R4 and R5 are set such that the voltage between the source and drain of the transistor 312 is approximately 200 volts. In one embodiment, the sum R4+R5 is in the range of 250–500 M ohms and this sum should be near, or somewhat greater than, the resistance (RW1 and RW2) of the spacer walls to conserve power. The optional Zener diodes 320*a*–320*b* can be added, if needed, to reach the source to drain voltage on transistor 312.

The time constant (R3×C3) sets the time at which the spacer electrode node 192 is sampled. The time constant (R1×C1) sets the speed of the operational amplifier 310. Further, the time constant of (R1×C1) should be similar to the time constant of (R3×C3 ) which should be approximately 1 ms. In one embodiment, the natural time constant of the spacer wall 130*a* is approximately 1–10 ms, therefore the above time constants are selected because the response of the operational amplifier 310 and the transistor 312 should not be much faster than the response time of the spacer walls 130*a*–310*e* because the transistor 312 will become saturated during fast changes in the faceplate voltage. It is appreciated that C2 and C4 are optional.

Lastly, the capacitors space C2 and C4 are selected to maintain the following relationship based on the desired voltage ratio:

$$(1/N)=\frac{(1/C4)}{[(1/C2)+(1/C4)]}$$

In a particular configuration where the ratio of (1/N) is 0.25, transistor 312 is a 450v FET device, R1 is 575 K ohms, R2 is 25 K ohms, R3 is 1 M ohms, R4 is 175 M ohms, R5 is 200 M ohms, R7 is 350 K ohms, R10 is 1 G ohms and R11 is 1 G ohms. Also, C2+C4 is between 100 and 50 pF. Including the capacitance of the walls, (CW1 and CW2), the above expression becomes:

$$(1/N)=\frac{(1/(C4+CW2))}{[(1/(C2+CW1))+(1/(C4+CW2))]}$$

The capacitance of the spacers themselves may have the correct ratio depending on their geometry. C2 and C4 are used to correct for any parasitic capacitances of connection leads, etc., and to maintain the balance of capacitances specified above.

Circuit 300 implements an operational amplifier-controlled current sink whereby the current sink includes transistor 312 and resistor R7. In operation, circuit 300 acts to maintain the selected voltage ratio (e.g., 0.25) between the spacer electrode node 192 and the high voltage node 254. The voltages at node 350 and 352 are held to be about equal. If the voltage at node 350 (the negative input) increases too much (e.g., as a result of the high voltage supply 250 putting too much voltage out), then operational amplifier 310 decreases its output voltage which acts to partially turn off the transistor 312. This acts to reduce the current flow through resistor R5 (and through transistor 312) which acts to increase the voltage at spacer electrode node 192. This acts to increase the voltage on node 352 in proper amount to compensate for the voltage increase at node 350. Conversely, if the voltage at node 350 (the negative input) decreases relative to the voltage at node 352 (e.g., as a result of the high voltage supply 250 putting too little voltage out), then operational amplifier 310 increases its output voltage which acts to turn on more the transistor 312. This acts to increase the current flow through resistor R5 (and through transistor 312 ) which acts to decrease the voltage at spacer electrode node 192. This acts to decrease the voltage on node 352 in proper amount to compensate for the voltage decrease at node 350.

Figure 6B:
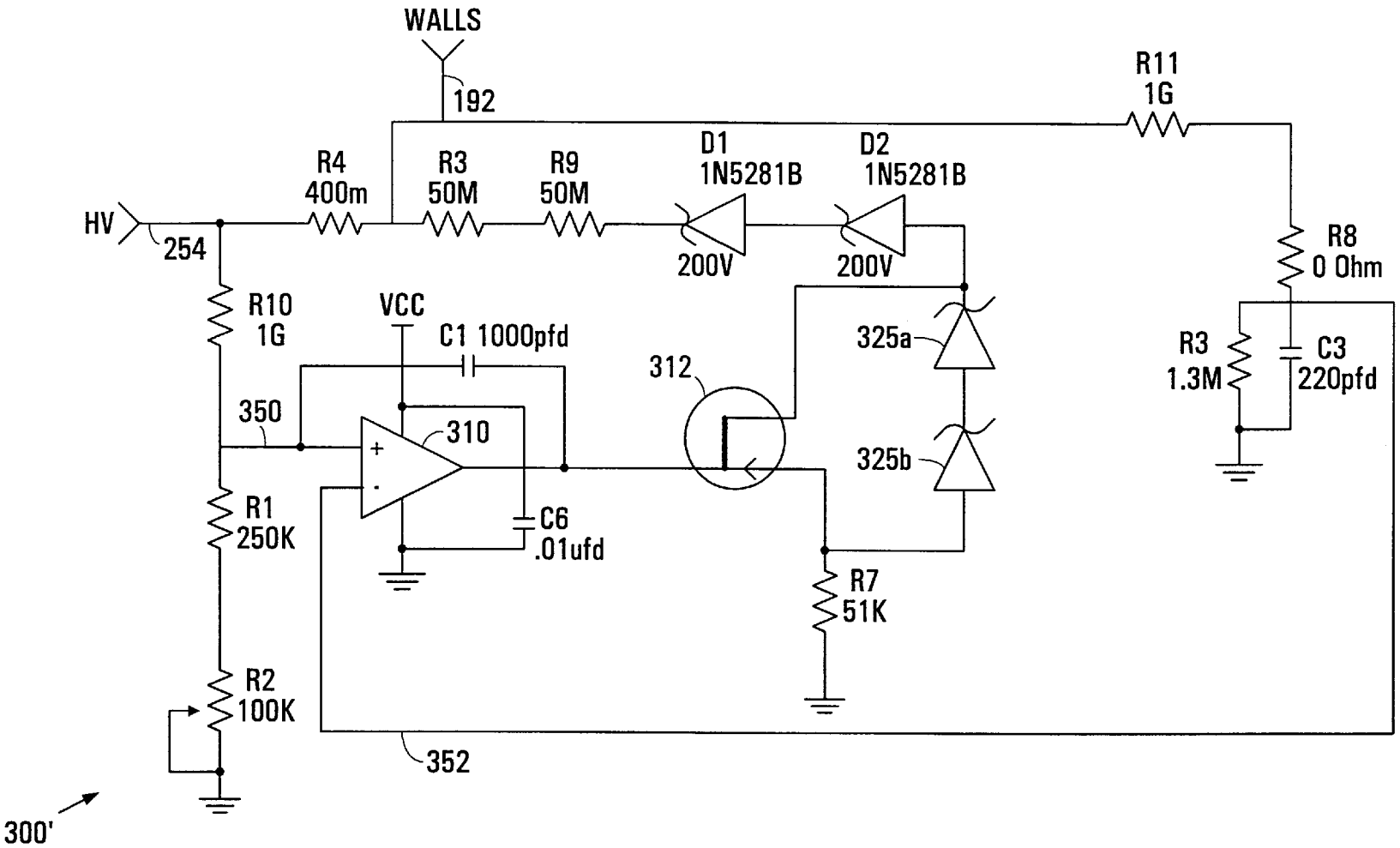
FIG. 6B is a schematic circuit diagram of the voltage ratio regulator circuit of the voltage ratio regulator system in accordance with a second embodiment of the present invention.

FIG. 6B illustrates a second embodiment 300' of the voltage regulator circuit of the present invention.

Figure 7:
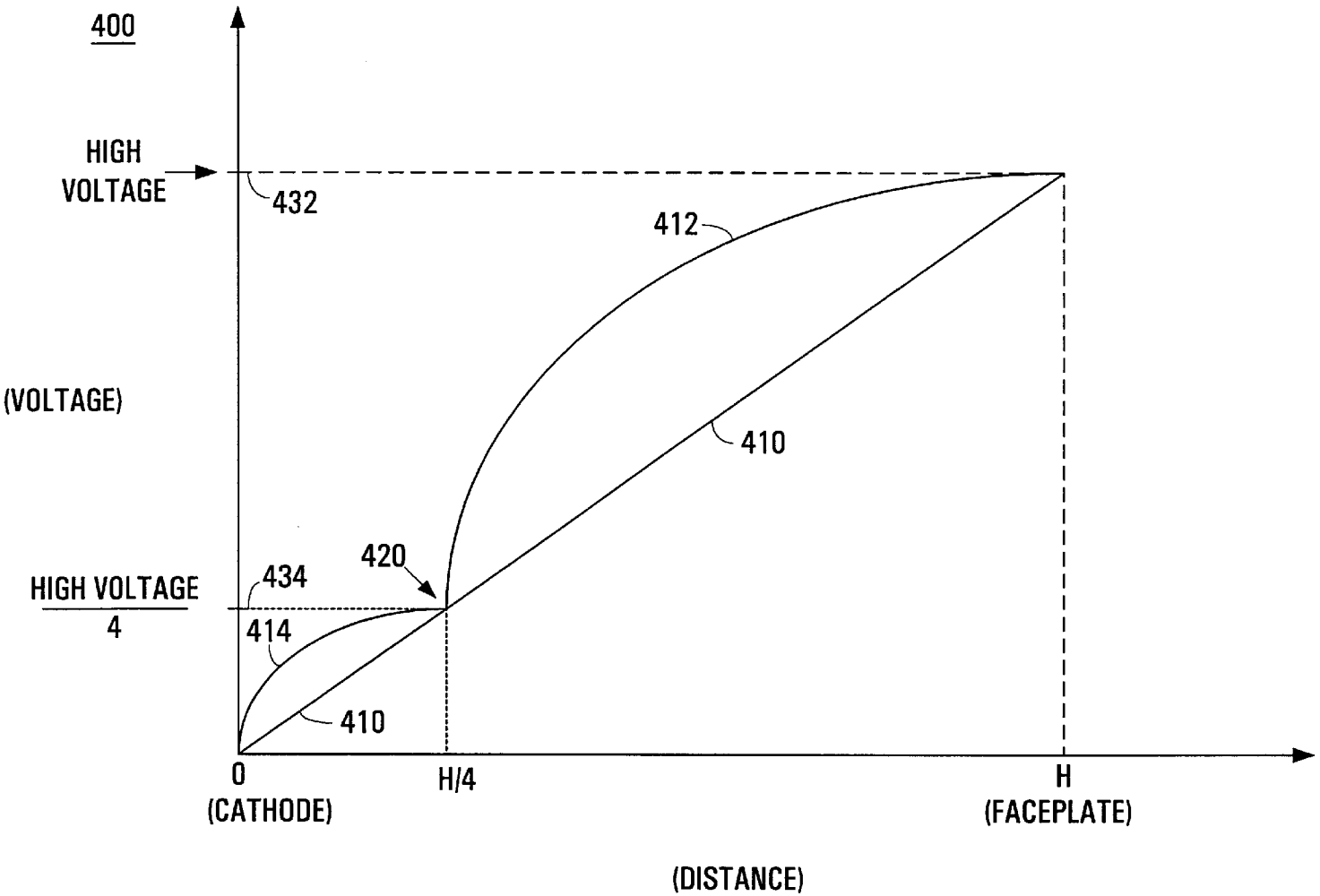
FIG. 7 is a graph illustrating the actual voltages and the ideal voltages along the height of the spacer wall of FIG. 3 in accordance with the present invention.

FIG. 7 illustrates a graph of the voltage along the height of the spacer wall 130*a* of FIG. 3 (from the cathode or backplate structure 164 to the faceplate structure 120) with the application of the spacer electrode 140*a* held to a voltage equal to approximately ¼ of the high voltage level. In this implementation, the spacer electrode 140*a* is positioned approximately ¼ of the height, H, of the spacer wall 130*a* above the backplate structure 164. This position is indicated by point 420. Line 410 represents the ideal voltage over the length of the spacer wall 130*a* from zero volts (cathode) to the high voltage level of the high voltage power supply 250 at the faceplate 120.

Curve 414 represents the voltage distribution along the spacer wall 130*a* from the backplate structure 164 to the location of the spacer electrode 140*a* which is held at ¼ the voltage of the high voltage amount by the voltage ratio regulator circuit 300 when thermal gradients exist. Curve 412 represents the voltage distribution along the spacer wall 130*a* from the spacer electrode 140*a* to the faceplate structure 120 (when a thermal gradient exists) which is maintained at the high voltage level by the voltage ratio regulator circuit 300. Curves 414 and 412 are separated by point 420. As shown by FIG. 7, both curves 414 and 412 are more positive in voltage over the ideal voltage line 410 due to temperature gradients along the spacer wall 130*a*.

Figure 8:
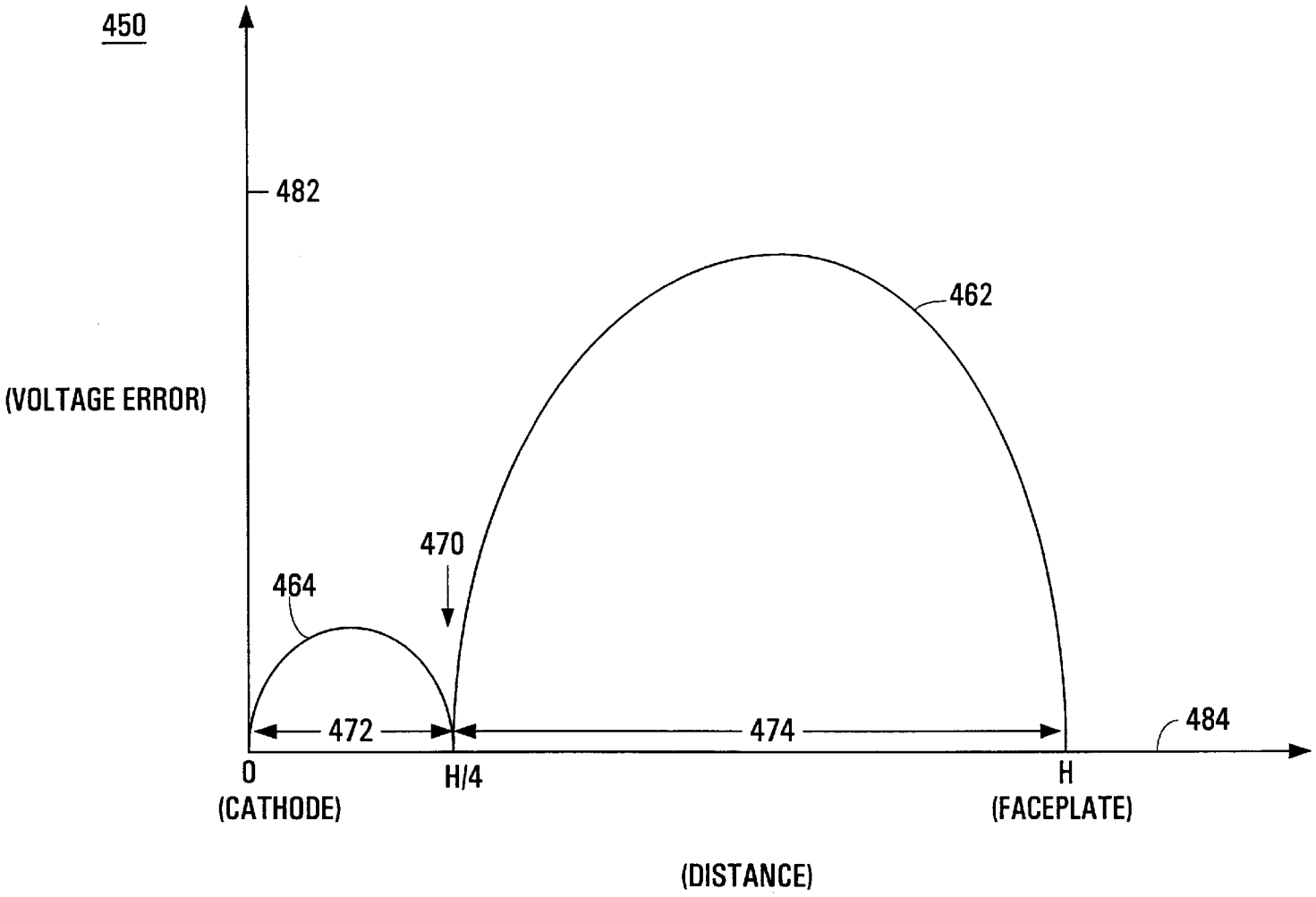
FIG. 8 is a graph illustrating the voltage error between the actual voltages and the ideal voltages along the height of the spacer wall of FIG. 3 in accordance with the present invention.

FIG. 8 illustrates the voltage error curves 464 and 462 over the length of the spacer wall 130*a* from the backplate structure 164 to the faceplate structure 120. Curves 464 and 462 are both parabolic in shape. Curve 464 represents the voltage error of curve 414 from the ideal line 410. Curve 462 represents the voltage error of curve 412 from the ideal line 410. The area under the curves 464 and 462 is less than the area under the voltage error distribution graph that would exist without placement of the spacer electrode 130*a* with correcting voltage.

Not only is the total voltage error reduced compared to a spacer wall without a spacer electrode, but the present invention significantly reduces the voltage error the most within the regions that the electrons spend most of their time. For instance, it is appreciated that the electrons emitted from the backplate structure 164 start at the bottom and accelerate toward the faceplate structure 120. These electrons start out with a slower speed and therefore spend most (e.g., over half) of their time traveling through length 472, e.g., from the backplate structure 164 to the spacer electrode 140 a located ¼ H above the backplate structure 164. They spend the balance of their flight through length 474, e.g., between the spacer electrode 140*a* and the faceplate structure 120, gradually accelerated toward faceplate structure 120.

Therefore, to provide the maximum influence of the correcting voltage applied to the spacer electrode 140*a*, the spacer electrode 140*a* is positioned within a spatial region in which the electrons spend a large percentage of their time. In other words, the electrons "see" the spacer electrode 140*a* more if it is positioned within the lower ¼ of the height H of the spacer wall 130*a*. For this reason, the spacer electrode 130*a* is positioned, in a preferred embodiment, at a location ¼ of the distance, H, above the backplate structure 164. As a result, while curve 462 of FIG. 8 represents a larger error over curve 464, the electrons travel through this spatial region 474 very rapidly. Even so, the area under the error curve 462 is less than it would have been without placement of the spacer electrode 140*a*. On the other hand, the electrons travel much slower through region 472 and in this region, the area under the error curve 464 is very much less than it would have been without placement of the spacer electrode 140*a*. In summary, the voltage error distribution 472 is smallest in the region where the electrons spend most of their time.

Additional Functions of Spacer Voltage Regulator Circuits

The presence of the spacer walls can cause deflections of the nearby electron beams, even in the absence of charging or thermal gradients. The deflection is due to an imperfect match between the physical ends of the spacer and the "effective electrical ends" of the faceplate and cathode. The faceplate and the cathode are not completely planar and their structure (phosphor and polyimide on faceplate, electron beam focusing structure on the cathode) modifies the effective position of their surfaces from the point of view of the electric fields in the device. The electrical ends of the spacer, however, line up nearly exactly with physical ends. If the spacer and surface electrical ends do not match, an electron beam deflection of the pixels near the spacer will result. This can be compensated for in a number of ways, but the circuit 300 of the present invention provides a very convenient adjustment because it can be made after the thin-CRT display device is completely assembled.

Manufacturing variations in the heights and shapes of the cathode and faceplate structures can cause the built-in pixel deflection (from electrical end mismatch) to vary somewhat from display to display, but the variation within a single display can be better controlled. The ratio of the electrode to faceplate voltage, which is nominally the same as the height ratio of the electrode on the spacer, can be adjusted on each individual thin-CRT display device to provide a small voltage error on the spacer which best compensates for electrical end mismatch on that specific device. When properly adjusted the average centers of brightness of the pixels adjacent is made in practice by changing the setting of variable resistor R2, which functions as a "wall hide" control knob.

Besides thermal gradient induced voltage errors, voltage errors arise on the spacer as a result of bombardment by stray electrons. These electrons are ones from the cathode which Rutherford scatter from the faceplate as well as secondary electrons which are produced when the electron beams from the cathode hit the faceplate. When hit by an electron, the spacer material will generally emit some secondary electrons. The number of electrons emitted depends on the material properties of its surface and the impact angle and energy of the electrons hitting it. If a non-zero net number of electrons are put on or taken away from the spacer the spacer will charge up. The charging produces a voltage error on the spacer which is generally greatest near the middle of the spacer, but does not have the simple parabolic form of the thermal gradient induced error due to the complex charging process. As with the thermal gradient voltage error, the circuit 300 of the present invention can reduce the deflection by minimizing the voltage error at and near the electrode on the spacer.

Unlike the thermal gradient error, the spacer charging occurs on a fast time scale (100 microsecond vs. 100 seconds). This is because of the manner in which the thin-CRT is operated. Individual rows of pixels are lit up in sequence starting at the top of the display and moving to the bottom, repeating the sequence 60 to 120 times a second. The spacers charge up only when the few rows of pixels around them are lit, and discharge when these pixels are off. Charge is removed by conduction through the resistive spacer on the 1–10 msec time scale. The resistance of the spacer cannot be reduced to remove this charge more quickly because it would increase the power consumption of the spacer. However the circuit can discharge the wall quickly if its dynamic response to the charging is optimized.

Ideally, the circuit 300 of the present invention should hold the spacer electrodes at a fixed percentage of the faceplate voltage at all timescales. Then the spacer near the common electrode would be discharged by the circuit at the same rate it is charged. There would still be some charge induced electrode and spacer ends, but it would be quite small. However, making a fast enough circuit is impractical because of cost, size, and power consumption requirements. The current circuit design will saturate its output stage if the response time (R1×C1 and R3×C3 ) is set too fast.

A good alternative is to adjust the circuit to hold the voltage rise on the electrodes by connecting the electrode to a capacitor, and adjusting the circuit to discharge this capacitor before the rows around the next spacer are lit up. The capacitor takes no power to run and, depending on design, the spacers themselves may have enough intrinsic capacitance (CW1 and CW2) when they are bussed together so that no external capacitors (C2 and C4) are really needed.

In order for the circuit 300 of the present invention to quickly discharge the capacitor(s), it must respond correctly to the fast voltage change on the electrode connection when a charge pulse hits one of these spacers. When the charge hits a spacer it causes a fast (100 microsecond) voltage change. Charge is transferred through the bussing connection from the electrode on the spacer that was hit to the other spacers. This reduces the voltage rise on the spacer that was hit, reducing the electrode beam deflection. However, it leaves some charge on the other spacers which then begins to migrate away from the electrode location. During the time period before the area around the next wall on the display is lit up, the circuit must remove or add charge to the spacers by turning the current through the transistor up or down sufficiently to bring the electrode voltage back to the correct (zero beam displacement) value.

In fact, it must push the voltage slightly beyond this value to compensate for charge which escaped off the electrodes and began to migrate on the spacers after the previous spacer was hit, but before the circuit had time enough to respond. To accomplish this type of response in practice the component values of the circuit 300 are adjusted such that it has the correct "natural frequency" and damping coefficient." These values are set by the time constant of the circuit (R1×C1 and R3×C3 ) and the overall gain, most conveniently controlled by the value of R7. For our current design, reducing the time constant to 0.25 ms and a gain of 2.5 was found to be optimal.

The preferred embodiment of the present invention, a voltage ratio regulator circuit for regulating the voltage of a spacer electrode which is used to compensate for temperature induced (and other) electron deflections within an FED device, is thus described. While the present invention has been described in particular embodiments, it should be appreciated that the present invention should not be construed as limited by such embodiments, but rather construed according to the below claims.

What is claimed is:

1. A voltage ratio regulator circuit comprising:

a first voltage divider circuit coupled to receive a high voltage from a high voltage power supply, said first voltage divider circuit for providing a first divided voltage to a first input of an operational amplifier circuit;

a second voltage divider circuit coupled to receive a voltage of a spacer electrode of a spacer within a display unit, said second voltage divider circuit for providing a second divided voltage to a second input of said operational amplifier circuit; and said operational amplifier circuit for maintaining a voltage ratio between said voltage of said spacer electrode and said high voltage by generating a first output state for increasing the voltage at said second input of said operational amplifier in response to an increase in said high voltage of said high voltage power supply and by generating a second output state for decreasing the voltage at said second input of said operational amplifier in response to a decrease in said high voltage of said high voltage power supply.

2. A voltage ratio regulator circuit as described in claim 1 wherein said voltage ratio is approximately 0.25.

3. A voltage ratio regulator circuit as described in claim 1 wherein said high voltage is within the range of 400 to 10,000 volts.

4. A voltage ratio regulator circuit as described in claim 1 further comprising a transistor circuit controlled by an output of said operational amplifier circuit, said transistor circuit coupled to ground through a first resistor and coupled to said voltage of said spacer electrode through a second resistor, said transistor for restricting current, through said first and second resistors, to ground in response to said first output state and for dumping current, through said first and second resistors, to ground in response to said second output state.

5. A voltage ratio regulator circuit as described in claim 4 wherein said transistor circuit is a field effect transistor (FET).

6. A voltage ratio regulator circuit as described in claim 4 wherein said transistor circuit is a bipolar NPN transistor.

7. A voltage ratio regulator circuit as described in claim 1 wherein said first voltage divider circuit comprises a first resistor (R1) and a second resistor (R2) coupled between said first input of said operational amplifier and ground and wherein said second voltage divider circuit comprises a third resistor (R3) coupled between said second input of said operational amplifier circuit and ground.

8. A voltage ratio regulator circuit as described in claim 7 wherein said voltage ratio between said voltage of said spacer electrode and said high voltage is equal to [(R1+R2)/R3 ].

9. A voltage ratio regulator system for a field emission display device comprising:

a high voltage power supply coupled between a faceplate and a baseplate, said faceplate and said baseplate separated by a distance, H;

a spacer coupled between said faceplate and said baseplate, said spacer having disposed thereon a spacer electrode for compensating for electron deflections induced by temperature gradients along said spacer; and a voltage regulator circuit coupled to receive a high voltage from said high voltage power supply, coupled to said spacer electrode and coupled to a reference voltage, said voltage regulator circuit for maintaining a voltage ratio between a voltage at said spacer electrode and said high voltage in response to voltage variations of said high voltage power supply.

10. A voltage ratio regulator system as described in claim 9 wherein said voltage ratio is approximately 0.25 and wherein said spacer electrode is located on said spacer at a height of approximately H/4 above said baseplate.

11. A voltage ratio regulator system as described in claim 9 wherein said voltage regulator circuit comprises:

a first voltage divider circuit coupled to receive said high voltage from said high voltage power supply, said first voltage divider circuit for providing a first divided voltage to a first input of an operational amplifier circuit;

a second voltage divider circuit coupled to receive said voltage from said spacer electrode, said second voltage divider circuit for providing a second divided voltage to a second input of said operational amplifier circuit; and said operational amplifier circuit for maintaining said voltage ratio between said voltage of said spacer electrode and said high voltage by generating a first output state for increasing the voltage at said second input of said operational amplifier in response to an increase in said high voltage of said high voltage power supply and by generating a second output state for decreasing the voltage at said second input of said operational amplifier in response to a decrease in said high voltage of said high voltage power supply.

12. A voltage ratio regulator system as described in claim 11 further comprising a transistor circuit controlled by an output of said operational amplifier circuit, said transistor circuit coupled to said reference voltage through a first resistor and coupled to said voltage said spacer electrode through a second resistor, said transistor for restricting current to said reference voltage, through said first and second resistors, in response to said first output state and for dumping current to said reference voltage, through said first and second resistors, in response to said second output state.

13. A voltage ratio regulator system as described in claim 12 wherein said transistor circuit is a field effect transistor (FET).

14. A voltage ratio regulator system as described in claim 12 wherein said transistor circuit is a bipolar NPN transistor.

15. A voltage ratio regulator system as described in claim 10 wherein said first voltage divider circuit comprises a first resistor (R1) and a second resistor (R2) coupled between said first input of said operational amplifier and said reference voltage and wherein said second voltage divider circuit comprises a third resistor (R3) coupled between said second input of said operational amplifier circuit and said reference voltage.

16. A voltage ratio regulator system as described in claim 15 wherein said voltage ratio between said voltage spacer electrode and said high voltage is equal to [(R1+R2)/R3 ].

17. A voltage ratio regulator system for a field emission display device comprising:

a high voltage power supply coupled between a faceplate and a baseplate, said faceplate and said baseplate separated by a distance, H;

a spacer coupled between said faceplate and said baseplate, said spacer having disposed thereon a spacer electrode for compensating for electron deflections induced by temperature gradients along said spacer, said spacer electrode disposed at a height H/N above said baseplate; and a voltage regulator circuit coupled to receive a high voltage from said high voltage power supply, coupled to said spacer electrode and coupled to ground, said voltage regulator circuit for maintaining a voltage ratio of 1/N between a voltage at said spacer electrode and said high voltage in response to voltage variations of said high voltage power supply.

18. A voltage ratio regulator system as described in claim 17 wherein said value N is 4.

19. A voltage ratio regulator system as described in claim 18 wherein said voltage regulator circuit comprises:

a first voltage divider circuit coupled to receive said high voltage from said high voltage power supply, said first voltage divider circuit for providing a first divided voltage to a first input of an operational amplifier circuit;

a second voltage divider circuit coupled to receive said voltage from said spacer electrode, said second voltage divider circuit for providing a second divided voltage to a second input of said operational amplifier circuit; and said operational amplifier circuit for maintaining a voltage ratio between said voltage of said spacer electrode and said high voltage by generating a first output state for increasing the voltage at said second input of said operational amplifier in response to an increase in said high voltage of said high voltage power supply and by generating a second output state for decreasing the voltage at said second input of said operational amplifier in response to a decrease in said high voltage of said high voltage power supply.

20. A voltage ratio regulator system as described in claim 19 wherein said first voltage divider circuit comprises a first resistor (R1) and a second resistor (R2) coupled between said first input of said operational amplifier and ground and wherein said second voltage divider circuit comprises a third resistor (R3) coupled between said second input of said operational amplifier circuit and ground and wherein further said voltage ratio between said voltage of said spacer electrode and said high voltage is equal to [(R1+R2)/R3].

21. A field emission display, comprising:

a faceplate;

a backplate including a cathode structure with a plurality of electron emitters;

a spacer system disposed with the field emission display, said spacer system including a plurality of spacer walls; and a voltage regulation system coupled to at least one spacer of the plurality of spacer walls to regulate effects of thermal and electrical gradients along surfaces of the plurality of spacer walls to reduce electron deflections due to the spacer walls in the field emission display.

22. A field emission display as described in claim 21 wherein said voltage regulation system comprises:

a first voltage divider circuit coupled to receive a high voltage from a high voltage from a high voltage supply, said first voltage divider circuit for providing a first divided voltage to a first input of an operational amplifier circuit;

a second voltage divider circuit coupled to receive a voltage of a spacer electrode of said at least one spacer, said second voltage divider circuit for providing a second divided voltage to a second input of said operational amplifier circuit; and said operational amplifier circuit for maintaining a voltage ratio between said voltage of said spacer electrode and said high voltage by generating a first output state for increasing the voltage at said second input of said operational amplifier in response to an increase in said high voltage of said high voltage power supply and by generating a second output state for decreasing the voltage at said second input of said operational amplifier in response to a decrease in said high voltage of said high voltage power supply.

* * * * *